US009709056B2

(12) United States Patent
Nakazawa et al.

(10) Patent No.: US 9,709,056 B2
(45) Date of Patent: Jul. 18, 2017

(54) SEALING FOR A PUMP DEVICE

(71) Applicant: Hitachi Automotive Systems, Ltd., Hitachinaka-shi, Ibaraki (JP)

(72) Inventors: Chiharu Nakazawa, Kawasaki (JP); Masaki Misunou, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 453 days.

(21) Appl. No.: 14/355,397

(22) PCT Filed: Nov. 22, 2012

(86) PCT No.: PCT/JP2012/080291

§ 371 (c)(1),
(2) Date: Apr. 30, 2014

(87) PCT Pub. No.: WO2013/077398

PCT Pub. Date: May 30, 2013

(65) Prior Publication Data

US 2014/0294649 A1 Oct. 2, 2014

(30) Foreign Application Priority Data

Nov. 25, 2011 (JP) ..... 2011-256914

(51) Int. Cl.
*F04C 15/00* (2006.01)
*F04C 2/08* (2006.01)
(Continued)

(52) U.S. Cl.
CPC ..... *F04C 15/0026* (2013.01); *F01C 19/005* (2013.01); *F04C 2/08* (2013.01);
(Continued)

(58) Field of Classification Search
CPC ..... F04C 15/0038; F04C 15/0026; F01C 19/005
See application file for complete search history.

(56) References Cited

U.S. PATENT DOCUMENTS 6,347,843 B1 2/2002 Murayama et al.
7,726,661 B2 * 6/2010 Orlowski ..... F16J 15/187 277/412

(Continued)

FOREIGN PATENT DOCUMENTS

JP 58-194286 U 12/1983
JP 2000-54968 A 2/2000

(Continued)

OTHER PUBLICATIONS

International Search Report dated Jan. 22, 2013 with English translation (five (5) pages).

*Primary Examiner* — Mary A Davis
(74) *Attorney, Agent, or Firm* — Crowell & Moring LLP

(57) ABSTRACT

In a hollow seal member kept in abutted-engagement with a shaft hole formed in a housing via an elastic body and kept in sliding-contact with an outer circumference of a drive shaft for sealing against a leakage of fluid from a pump chamber, the seal member is provided with a seal part formed within an area at one end and kept in sliding-contact with the outer circumference of the drive shaft over a given hollow inner circumferential surface, and a rotation-stopping part formed within an area at the other end for restricting a movement of the seal member in a rotation direction of the drive shaft. A rotational resistance of the rotation-stopping part to the drive shaft is set to be less than a rotational resistance of the seal part.

10 Claims, 8 Drawing Sheets

(51) Int. Cl.
*F04C 2/10* (2006.01)
*F01C 19/00* (2006.01)
*F04C 2/14* (2006.01)

(52) U.S. Cl.
CPC ..... *F04C 2/10* (2013.01); *F04C 2/14* (2013.01); *F04C 15/0038* (2013.01)

(56) References Cited

U.S. PATENT DOCUMENTS

| | | | | |
|---|---|---|---|---|
| 8,678,798 | B2 * | 3/2014 | Nakamura | F04C 15/0038 418/104 |
| 8,814,547 | B2 * | 8/2014 | Walgren | F04C 15/0038 418/205 |
| 8,992,194 | B2 * | 3/2015 | Nakamura | F04C 15/0038 418/104 |
| 2011/0103992 | A1 * | 5/2011 | Cully | F04C 15/0026 418/144 |

FOREIGN PATENT DOCUMENTS

| | | | |
|---|---|---|---|
| JP | 2009-108688 | A | 5/2009 |
| JP | 2010-116948 | A | 5/2010 |
| JP | 2011-58588 | A | 3/2011 |

* cited by examiner

SEALING FOR A PUMP DEVICE

TECHNICAL FIELD

The present invention relates to a pump device.

BACKGROUND ART

Patent document 1 discloses, in a shaft seal of a rotary pump, a seal structure for preventing a leakage of fluid to the outside of a pump device even under application of fluid pressure of a high pressure value.

CITATION LIST

Patent Literature

Patent document 1: Japanese patent provisional publication No. 2000-054968 (A)

SUMMARY OF INVENTION

Technical Problem

However, in the prior art pump device as described previously, rotation of a rotatable shaft is prevented due to a sliding frictional drag between the rotatable shaft and a non-rotatable shaft seal, and thus there is a possibility that a mechanical efficiency of the pump deteriorates.

It is, therefore, in view of the previously-described drawbacks of the prior art, an object of the invention to provide a pump device capable of suppressing a deterioration in mechanical efficiency, occurring owing to a seal structure.

Solution to Problem

In order to accomplish the aforementioned and other objects, according to the present invention, a hollow seal member, which is kept in abutted-engagement with a shaft hole formed in a housing via an elastic body and kept in sliding-contact with an outer circumference of a drive shaft for sealing against a leakage of fluid from a pump chamber, is provided with a seal part formed within an area at one end and kept in sliding-contact with the outer circumference of the drive shaft over a given hollow inner circumferential surface, and a rotation-stopping part formed within an area at the other end for restricting a movement of the seal member in a rotation direction of the drive shaft, wherein a rotational resistance of the rotation-stopping part to the drive shaft is set to be less than a rotational resistance of the seal part.

Advantageous Effects of Invention

Hence, according to the invention, it is possible to suppress a rotational resistance, thus suppressing a deterioration in mechanical efficiency.

DESCRIPTION OF EMBODIMENTS

Figure 1:
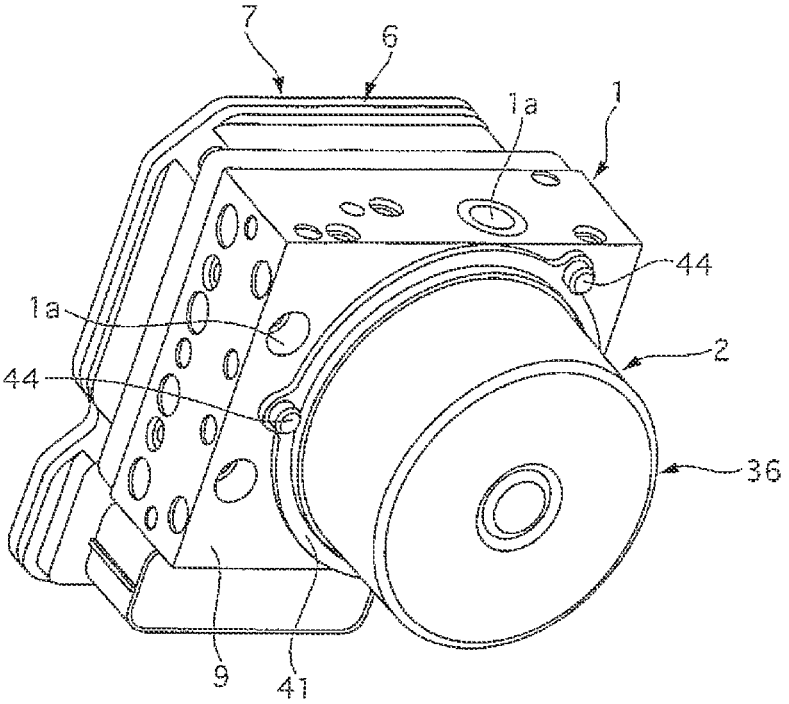
FIG. 1 is a perspective view illustrating the first embodiment of a gear pump.

A mode for carrying out a motor and a brake apparatus using the motor according to the invention is hereinafter described in reference to the embodiments shown in the drawings.

[First Embodiment]

Figure 2:
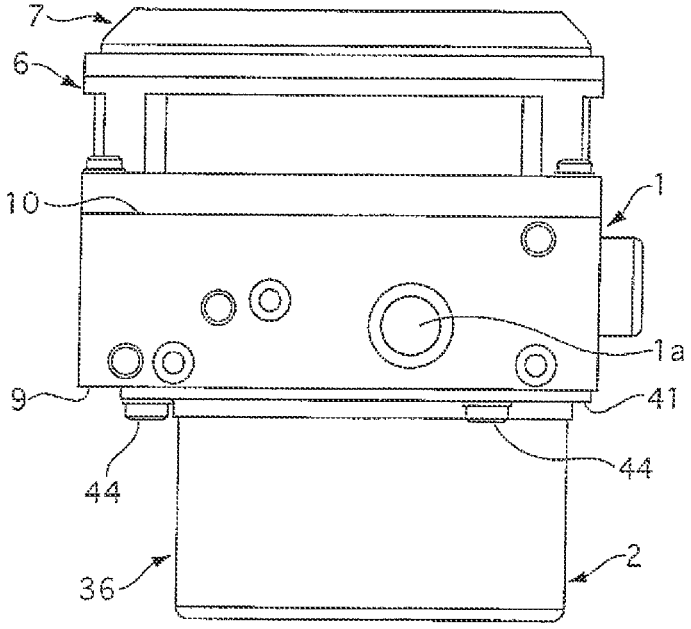
FIG. 2 is a side view illustrating the gear pump of the first embodiment.
Figure 3:
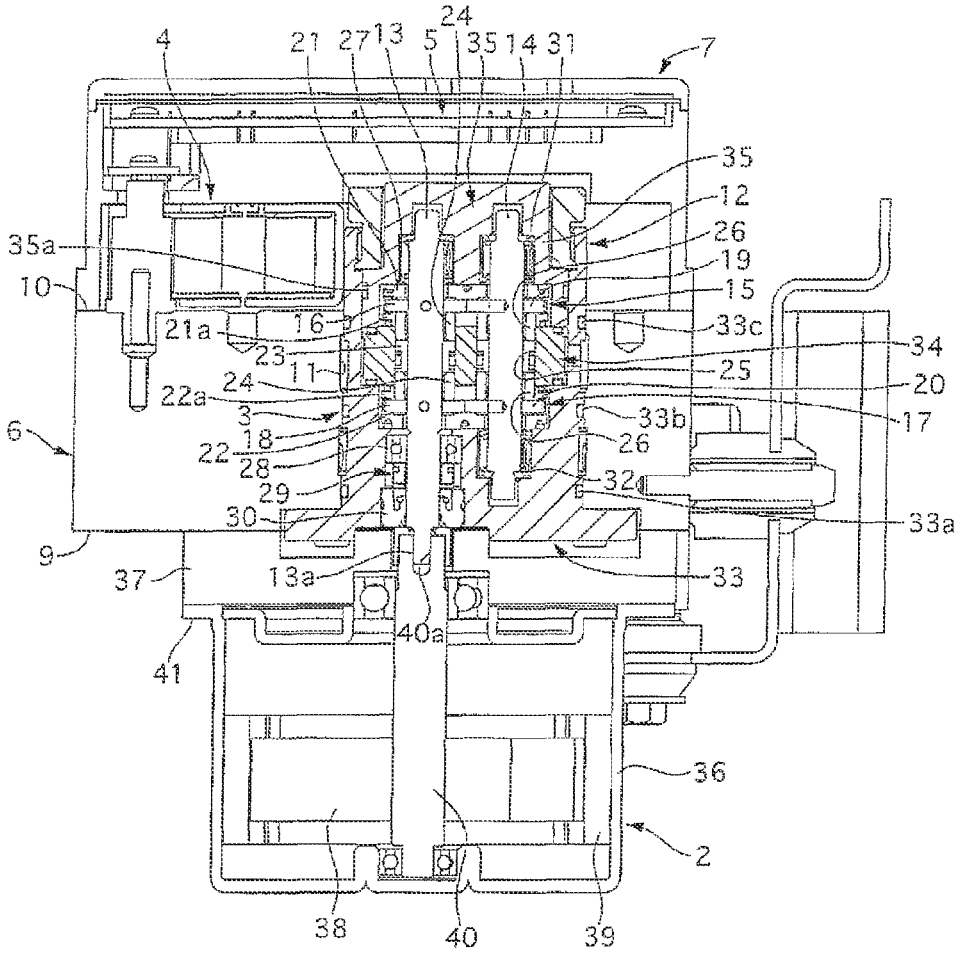
FIG. 3 is a cross-sectional view illustrating the gear pump of the first embodiment.

The brake apparatus of the first embodiment is provided for controlling a wheel-cylinder pressure of each road wheel of a vehicle, and equipped with a gear pump for pressurizing brake fluid. FIG. 1 is the perspective view of the brake apparatus of the first embodiment. FIG. 2 is the side view of the brake apparatus of the first embodiment. FIG. 3 is the cross-sectional view of the brake apparatus of the first embodiment.

The brake apparatus of the first embodiment is provided for controlling a plurality of wheel-cylinder pressures of the vehicle, and equipped with a housing 1 and an electric motor (hereinafter referred to as "motor") 2. In the following description, one of both sides of housing 1 in the axial direction of the gear pump, facing the motor 2, is referred to as "axial-direction positive side", whereas the other side, opposite to the one side, is referred to as "axial-direction negative side".

[Construction of Housing]

Housing 1 has a built-in gear pump 3, a plurality of built-in electromagnetic valves 4, and a built-in control board 5. The gear pump has oil passages (fluid flow passages) formed therein, such that brake fluid can flow through each fluid flow passage. The plurality of electromagnetic valves are configured to switch or change the path of flow through the valves. The control board is configured to control the motor 2 and the plurality of electromagnetic valves 4. Each of the fluid flow passages is configured to communicate with a master cylinder mounted on the vehicle and also communicate with each individual wheel cylinder mounted on the vehicle. Housing 1 is shaped into a substantially rectangular shape. A plurality of openings 1*a* are formed in the outside face of the housing, for forming the flow passages and for installing electromagnetic valves 4 and sensors (not shown) and the like.

Housing 1 has a housing main body 6 and a cover member 7. Motor 2 is installed on the axial-direction positive side face (one end face) 9 of housing main body 6, whereas the plurality of electromagnetic valves 4 are installed on the axial-direction negative side face 10 of the housing main body. An accommodation part (a gear-pump chamber) 11 is defined in the housing main body 6 for accommodating therein the gear pump 3.

The outer circumference of gear pump 3 is covered by a pump case 12. Pump case 12 is press-fitted and fixed to the accommodation part 11. A drive shaft 13 and a driven shaft 14 are installed in the pump case 12 and arranged parallel to each other. A first drive gear 16 of a first external gear 15 and a second drive gear 18 of a second external gear 17 are fixedly connected to the drive shaft 13. A first driven gear 19 of the first external gear 15 and a second driven gear 20 of the second external gear 17 are fixedly connected to the driven shaft 14.

A first seal block 21 is kept in abutted-engagement with the axial-direction negative side of the first external gear 15 for sealing the meshing portion of the first external gear 15. A first side plate 21*a* is kept in abutted-engagement with the axial-direction positive side of the first external gear. A second seal block 22 is kept in abutted-engagement with the axial-direction positive side of the second external gear 17 for sealing the meshing portion of the second external gear 17. A second side plate 22*a* is kept in abutted-engagement with the axial-direction negative side of the second external gear.

A drive-side holder member 23 and drive-side side plate fitting members 24 are interposed between the first drive gear 16 and the second drive gear 18. A driven-side holder member 25 and driven-side side plate fitting members 26 are interposed between the first driven gear 19 and the second driven gear 20.

The axial end of the axial-direction negative side of drive shaft 13 is rotatably supported by a needle bearing 27, whereas the axial end of the axial-direction positive side of the drive shaft is rotatably supported by a ball bearing 28. A pressure-reducing seal member 29 and a drive-side seal member 30 are installed on the axial-direction positive side of ball bearing 28 for preventing an oil leakage. The axial end of the axial-direction positive side of drive shaft 13 is configured to further protrude from the drive-side seal member 30 toward the axial-direction positive side. The tip of the protruding portion is formed as a width-across flat portion 13*a*. The axial end of the axial-direction negative side of driven shaft 14 is rotatably supported by a needle bearing 31. The axial end of the axial-direction positive side of the driven shaft is rotatably supported by a needle bearing 32.

By the way, pump case 12 is comprised of a front case 33, a center plate 34, and a rear case 35. O rings 33*a*, 33*b*, and 33*c* are installed on the outer circumference of front case 33. An O ring 35*a* is installed on the outer circumference of rear case 35.

[Motor Construction]

Motor 2 is equipped with a motor housing 36 and an end-plate member 37. Motor housing 36 is formed into a cylindrical shape closed at one end. A rotor 38, a stator 39, and a motor shaft (a rotation axis) 40 are accommodated in the motor housing. The rim of the circumference of the opening end of motor housing 36 is formed as a flange portion 41. Flange portion 41 has three equidistant-spaced bolt holes formed at equal pitches in the circumferential direction. The axial-direction positive side face 9 of housing main body 6 has three screw-threaded holes respectively configured at positions conformable to the three bolt holes. Motor housing 36 is fixedly connected to the housing main body 6 by means of bolts 44.

Stator 39 is fixedly connected onto the inner circumference of motor housing 36. Rotor 38 is located inside of the stator 39 and installed to be rotatable relative to the stator 39. Motor shaft 40 is formed integral with or integrally connected to the rotor 38. The tip of the axial end of the motor shaft is formed with a width-across flat receiving slot 40*a*, which is brought into engagement with the width-across flat portion 13*a* of drive shaft 13. With the width-across flat portion 13*a* and the width-across flat receiving slot 40*a* kept in engagement with each other, drive shaft 13 and motor shaft 40 rotate integrally with each other.

(Regarding Construction of Pressure-Reducing Seal Member)

Figure 4:
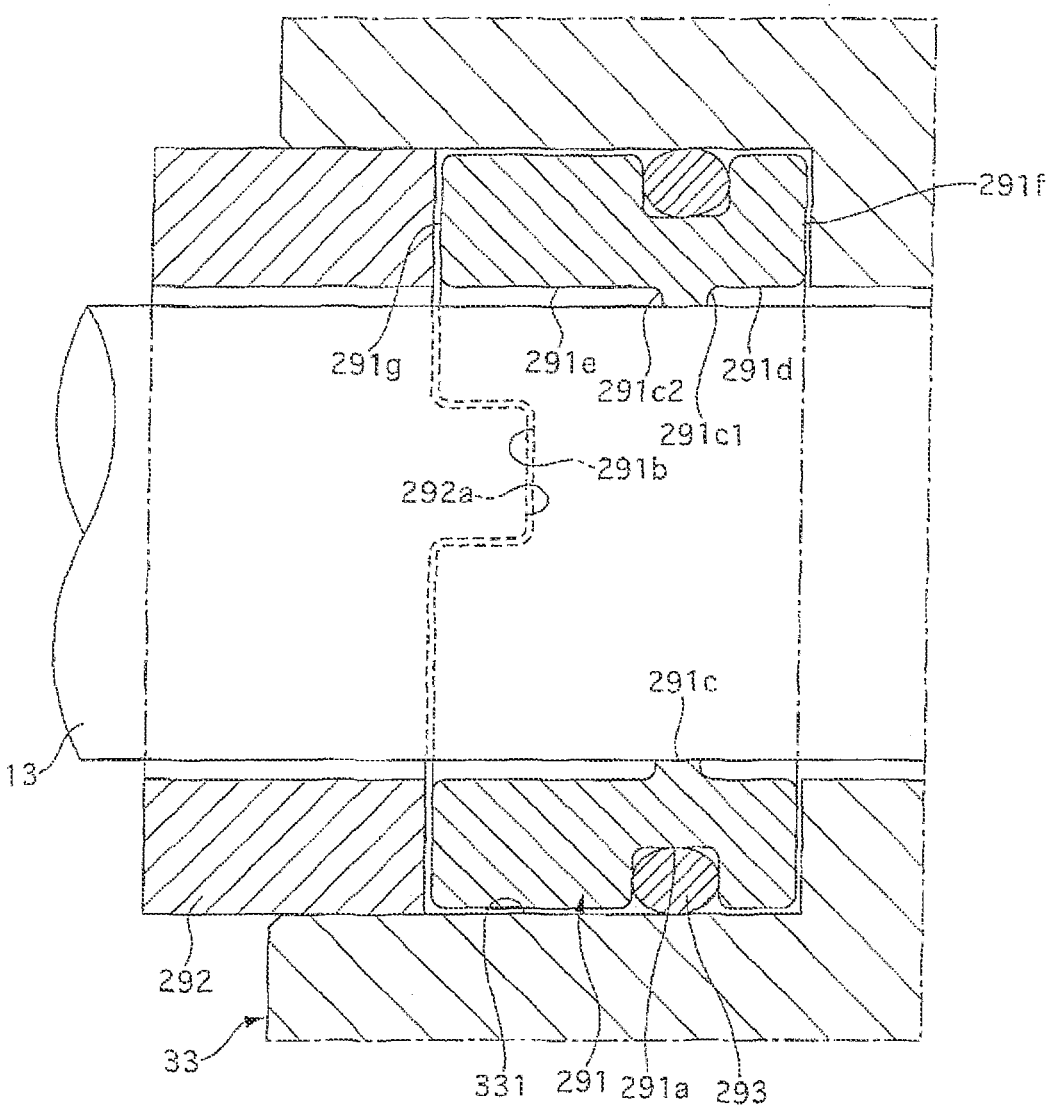
FIG. 4 is a cross-sectional view illustrating the construction of a pressure-reducing seal member in a pump device of the first embodiment.

The construction of the pressure-reducing seal member of the first embodiment is hereunder explained. FIG. 4 is the cross-sectional view illustrating the construction of the pressure-reducing seal member in the pump device of the first embodiment. For the purpose of simplification of the disclosure, ball bearing 28 is illustrated or simplified as a shading area, and this figure shows a state before the drive-side seal member 30 is installed.

Figure 5:
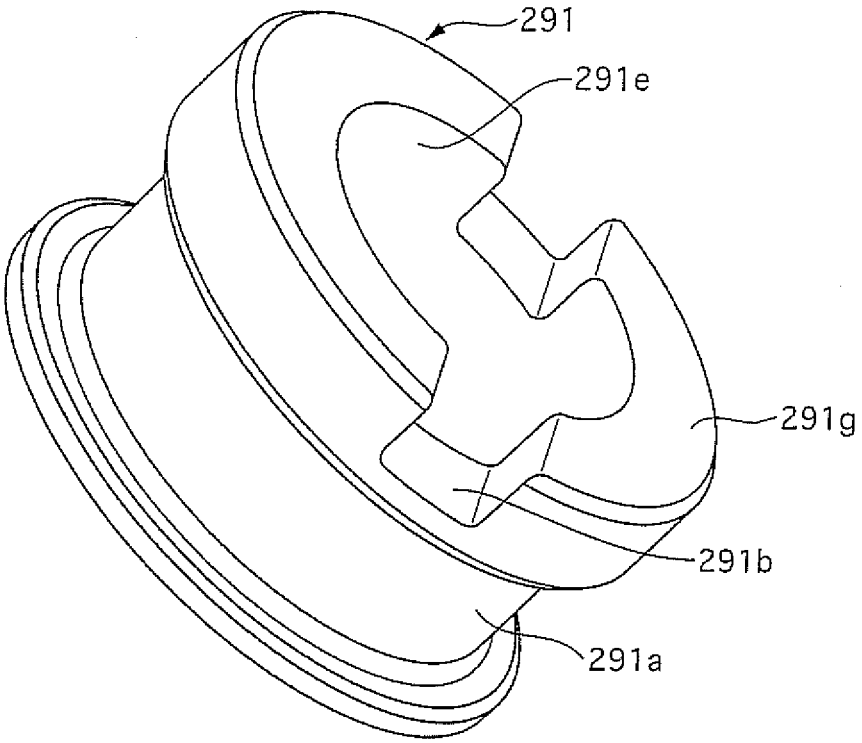
FIG. 5 is a perspective view illustrating the construction of the seal member of the first embodiment.

Pressure-reducing seal member 29 is made from a resin, and has a cylindrical seal member 291 that exhibits a seal function and a restriction member 292 that restricts the seal member 291 in the rotation direction with respect to a shaft hole 331 formed in the front case 33 fixed to the housing 1. FIG. 5 is the perspective view illustrating the construction of the seal member of the first embodiment. Seal member 291 has an O-ring groove 291*a* formed in the outer circumference of the cylindrical portion, for retaining an O ring 293 serving as an elastic body. Also, seal member 291 has a seal part 291*c* formed on the inner circumference of the cylindrical portion on the side of gear pump 3 (i.e., one end) and kept in sliding-contact with the outer circumference of drive shaft 13. Seal part 291*c* is configured such that its axial position overlaps with the O ring 293 in the axial direction. In the first embodiment, the axial length of seal part 291*c* is dimensioned to be shorter than the groove width (the axial length) of O-ring groove 291*a*.

A first inner circumferential surface 291*d* is formed or configured as the inner circumferential section between an end face 291*f* of seal member 291 on the side of gear pump 3 and the seal part 291*c*. A curved connecting surface 291*c*1 is configured between the first inner circumferential surface 291*d* and the inner circumferential surface of seal part 291*c*, and whereby an annular clearance space is defined on the drive shaft 13. In other words, the first inner circumferential surface 291*d*, which is diametrically enlarged from the inner circumferential surface of seal part 291*c*, is provided.

A second inner circumferential surface 291*e* is formed or configured as the inner circumferential section between an end face 291*g* of seal member 291 on the side of motor 2 (i.e., the other end) and the seal part 291*c*. A curved connecting surface 291*c*2 is configured between the second inner circumferential surface 291*e* and the inner circumferential surface of seal part 291*c*, and whereby an annular clearance space is defined on the drive shaft 13. In other words, the second inner circumferential surface 291*e*, which is diametrically enlarged from the inner circumferential surface of seal part 291*c*, is provided.

The end face 291*g* of seal member 291 on the side of motor 2 is formed with a recessed portion 291*b* cut from the end face 291*g* toward the side of gear pump 3. Recessed portion 291*b* is configured at a position conformable to or brought into engagement with a protruding portion 292*a* of restriction member 292. By the way, the number of recessed portion 291*b* may be one or more recesses formed in the circumferential direction. Restriction member 292 is formed into a cylindrical shape. The restriction member is press-fitted into the shaft hole 331 and thus fixedly connected to the front case 33. The inner circumference of restriction member 292 is dimensioned to be greater than the outside diameter of drive shaft 13, and configured to be kept in a spaced, contact-free relationship with the drive shaft 13.

The operation is hereunder explained by contrast with a comparative example. The drawing (e.g., FIG. 7) of Patent document 1 (JP2000-054968), teaches the sealing configuration comprised of a resin part, which is fitted onto a drive shaft under a given tight-fit contact pressure to provide a fluid-tight seal, and an O ring installed on the outer circumference of the resin part. Hence, brake fluid, leaked along the drive shaft, is sealed between the drive shaft and the resin part. On the other hand, the outer circumferential side of the resin part is sealed by means of the O ring, thus preventing a leakage of brake fluid. However, as disclosed in the Patent document 1, assuming that, in the sliding-contact seal between the drive shaft and the resin part, the resin part is brought into sliding-contact with the drive shaft over a wider area in comparison with the width of the O ring, there is a drawback that the mechanical efficiency deteriorates. Normally, there is a less tendency for brake fluid to be leaked toward the sliding-contact portion. Besides, suppose that such a sealing configuration is considered as a countermeasure against a brake-fluid leakage which may occur due to a deterioration in sealing performance on the gear-pump side. In view of this, it is undesirable that a great sliding frictional drag is always occurring at the sliding-contact portion. In the event that the resin part has been rotated together with the drive shaft due to the previously-discussed sliding frictional drag, an undesirable wear of the O ring on the inner peripheral wall takes place, thereby resulting in a deterioration in the durability of the O ring.

For the reasons set out above, in the first embodiment, for the purpose of stopping rotation of seal member 291, recessed portion 291*b* is configured, and additionally restriction member 292 is provided for rotation-stop. Therefore, it is possible to avoid the durability of O ring 293 from deteriorating. However, in the case that the recessed portion 291*b* is configured for the purpose of stopping rotation, the axial length of the seal member tends to become longer and thus the area of sliding contact with the drive shaft 13 also tends to increase, and hence there is a possibility that the mechanical efficiency deteriorates. Therefore, in order to narrow the area in which the sliding frictional drag is occurring, the first inner circumferential surface 291*d* and the second inner circumferential surface 291*e* are formed to define the annular clearance space between each of the inner circumferential surfaces and the drive shaft 13. Additionally, the seal part 291*c*, whose axial length is dimensioned to be shorter than that of O-ring groove 291*a*, is formed between the first inner circumferential surface 291*d* and the second inner circumferential surface 291*e*.

Figure 6:
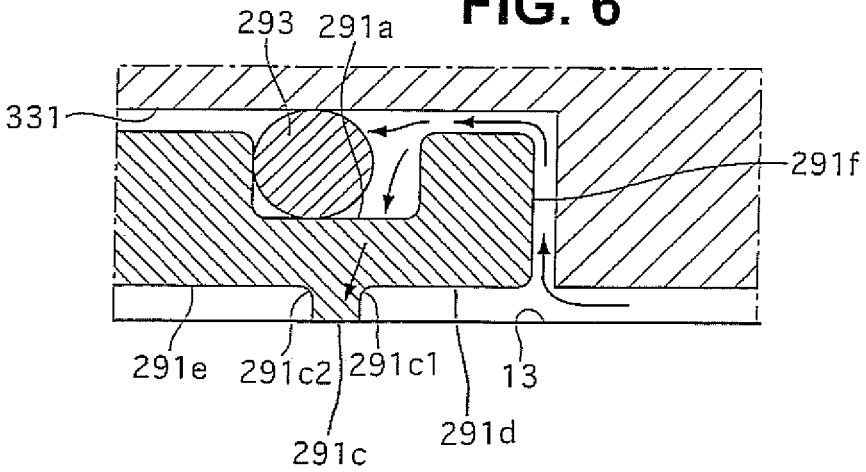
FIG. 6 is a schematic view in the case that brake fluid has been directed to or exerted on the seal member of the first embodiment.

The reason why the axial length of seal part 291*c* can be shortened is hereinafter explained in detail. FIG. 6 is the schematic view in the case that brake fluid has been directed to or exerted on the seal member of the first embodiment. In the case that high-pressure brake fluid is leaking through an aperture between the drive shaft 13 and the ball bearing 28, the brake-fluid pressure is directed to the annular clearance space defined between the first inner circumferential surface 291*d* and the drive shaft 13, and thus acts on the O ring 293. The brake-fluid pressure, acting on the O ring 293, pushes the O ring 293 to the left in FIG. 6, and also pushes the O-ring groove 291*a* toward the axial center. At this time, by virtue of the pushing force, seal part 291*c* is pushed toward the drive shaft 13. The higher the brake-fluid pressure, the greater the force pushing the seal part against the drive shaft can become.

Hence, it is possible to provide an appropriate sealing performance without securing the axial length of seal part 291*c* so much. Furthermore, under a normal condition that there is no leakage of brake fluid, the necessity of tightly pushing the seal part 291*c* against the drive shaft 13 is low. Thus, seal part 291*c* can be configured to provide a proper seal with a comparatively low pushing force. That is to say, it is possible to reduce the pushing force during normal operation while narrowing the sliding-contact area, thus greatly suppressing a deterioration in mechanical efficiency during normal operation.

As explained above, the pump device of the first embodiment can provide the following effects.

(1-1) The pump device is comprised of a housing 1, a drive shaft 13 fitted into a shaft hole 331 formed in a front case 33 fixed to the housing 1 and driven by a driving power source, a gear pump 3 installed in a pump chamber formed in the housing 1 and configured to be continuous with the shaft hole 331 and driven by the drive shaft 13, and a hollow seal member 291 kept in abutted-engagement with the shaft hole 331 via an O ring 293 (an elastic body) and kept in sliding-contact with an outer circumference of the drive shaft 13 for sealing against a leakage of fluid from the pump chamber. The seal member 291 is provided with a seal part 291*c* formed within an area at one end and kept in sliding-contact with the outer circumference of the drive shaft 13 over a given hollow inner circumferential surface, and a rotation-stopping part 291*b* formed within an area at the other end for restricting a movement of the seal member in a rotation direction of the drive shaft 13. A rotational resistance of the rotation-stopping part 291*b* to the drive shaft 13 is set to be less than a rotational resistance of the seal part 291*c*.

Hence, it is possible to avoid sliding motion of O ring 293 relative to the inner peripheral wall of shaft hole 331, thereby enhancing the durability of O ring 293. Additionally, the rotational resistance of the rotation-stopping part 291*b* to the drive shaft 13 is set to be less than the rotational resistance of the seal part 291*c*, and thus it is possible to suppress a deterioration in mechanical efficiency.

(2-2) An annular clearance space is provided or defined between the second inner circumferential surface 291*e*, which is a hollow inner circumferential surface corresponding to a recessed portion 291*b* (the rotation-stopping part), and an outer circumferential surface of the drive shaft 13.

Hence, it is possible to extremely reduce the rotational resistance, thereby highly suppressing a deterioration in mechanical efficiency.

(3-3) The annular clearance space is defined by the second inner circumferential surface 291*e* (a second inner circumferential surface), which is diametrically enlarged from the given inner circumferential surface (a hollow inner circumferential surface) of the seal part 291*c*, and a connecting surface that connects the second inner circumferential surface 291*e* and the given inner circumferential surface of the seal part 291*c*.

Hence, it is possible to form the annular clearance space only by machining the seal member 291 without making any machining on the drive shaft 13, thereby reducing the manufacturing costs.

(4-5) The O ring 293 (the elastic body) is fitted into an O-ring groove 291*a* (an annular groove) formed in an outer circumferential surface of the seal member 291. The seal part 291*c* is configured to have a width substantially conformable to an axial width of the O-ring groove 291*a*.

Hence, by forming the seal part 291*c* narrowly, it is possible to suppress a sliding frictional drag, thereby suppressing a deterioration in mechanical efficiency.

(5-6) The second inner circumferential surface 291*e* (a diametrically-enlarged part), formed by diametrically enlarging a hollow inner circumferential surface corresponding to a recessed portion 291*b* (the rotation-stopping part), is provided.

Hence, it is possible to reduce the rotational resistance, thereby suppressing a deterioration in mechanical efficiency.

[Second Embodiment]

Figure 7:
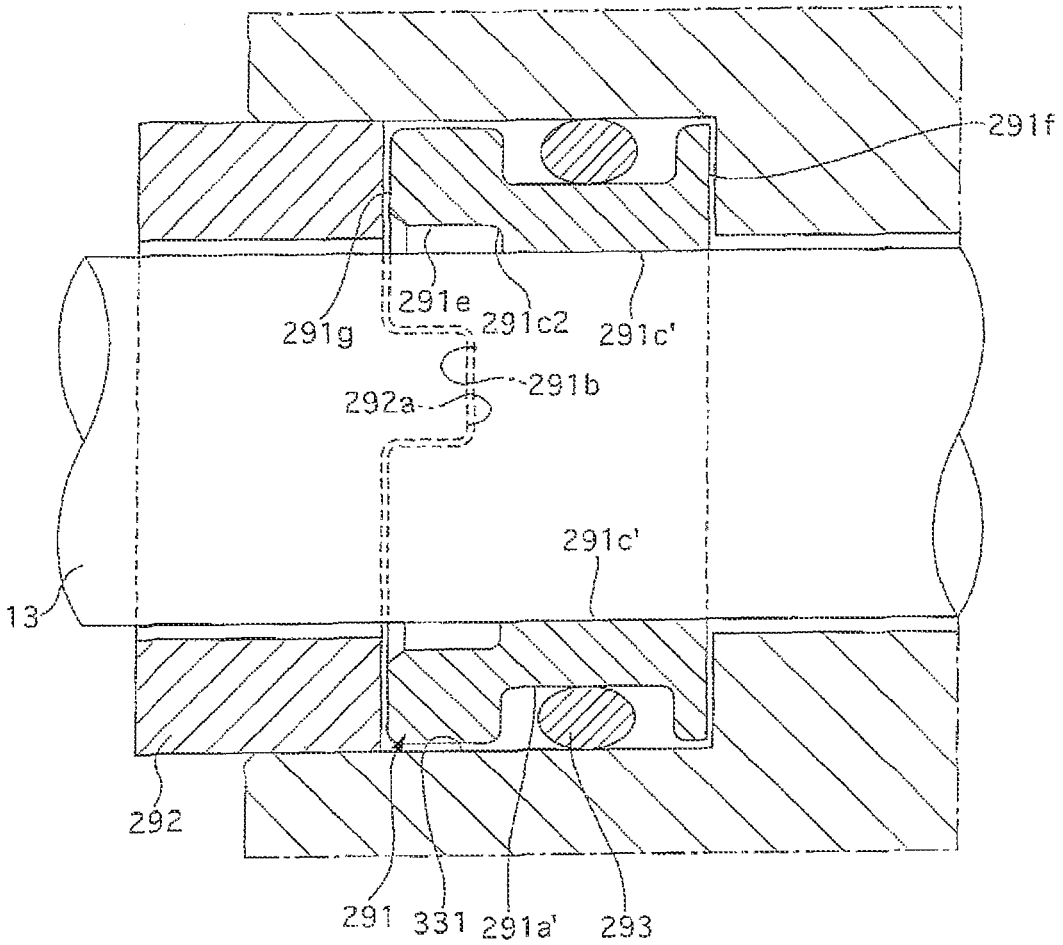
FIG. 7 is a cross-sectional view illustrating the construction of a pressure-reducing seal member in a pump device of the second embodiment.

The second embodiment is hereinafter explained. The fundamental construction is similar to the first embodiment, and therefore only the points of difference are hereunder described. FIG. 7 is the cross-sectional view illustrating the construction of the pressure-reducing seal member in the pump device of the second embodiment. As a different point, in the first embodiment the O-ring groove 291*a*' is configured such that the groove width is dimensioned to be approximately equal to the O ring 293, but in the second embodiment such an O-ring groove is configured over a given wider range than the width of O ring 293. Also, as another different point, in the first embodiment the first inner circumferential surface 291*d* is formed, but in the second embodiment such a first inner circumferential surface is not formed and additionally the seal part 291*c*' is formed or configured over a wider range than the width of the O-ring groove 291*a*'.

That is, in the second embodiment, O-ring groove 291*a* is configured over the given wider range. Hence, in the case that high-pressure brake fluid is leaking, seal member 291 can be forced or pushed toward the axial center over a wider range in the axial direction. Furthermore, seal part 291*c*' is configured over a wider range, and thus it is possible to enhance the sealing performance. In other words, O-ring groove 291*a*' is wide and seal part 291*c*' is wide, and thus it is possible to produce an adequate pushing force only when a leakage has occurred without always tightly pushing the seal part 291*c*' against the drive shaft 13 under a normal condition that there is no leakage of brake fluid. Hence, it is possible to suppress a sliding frictional drag during normal operation, thereby suppressing a deterioration in mechanical efficiency.

[Third Embodiment]

Figure 8:
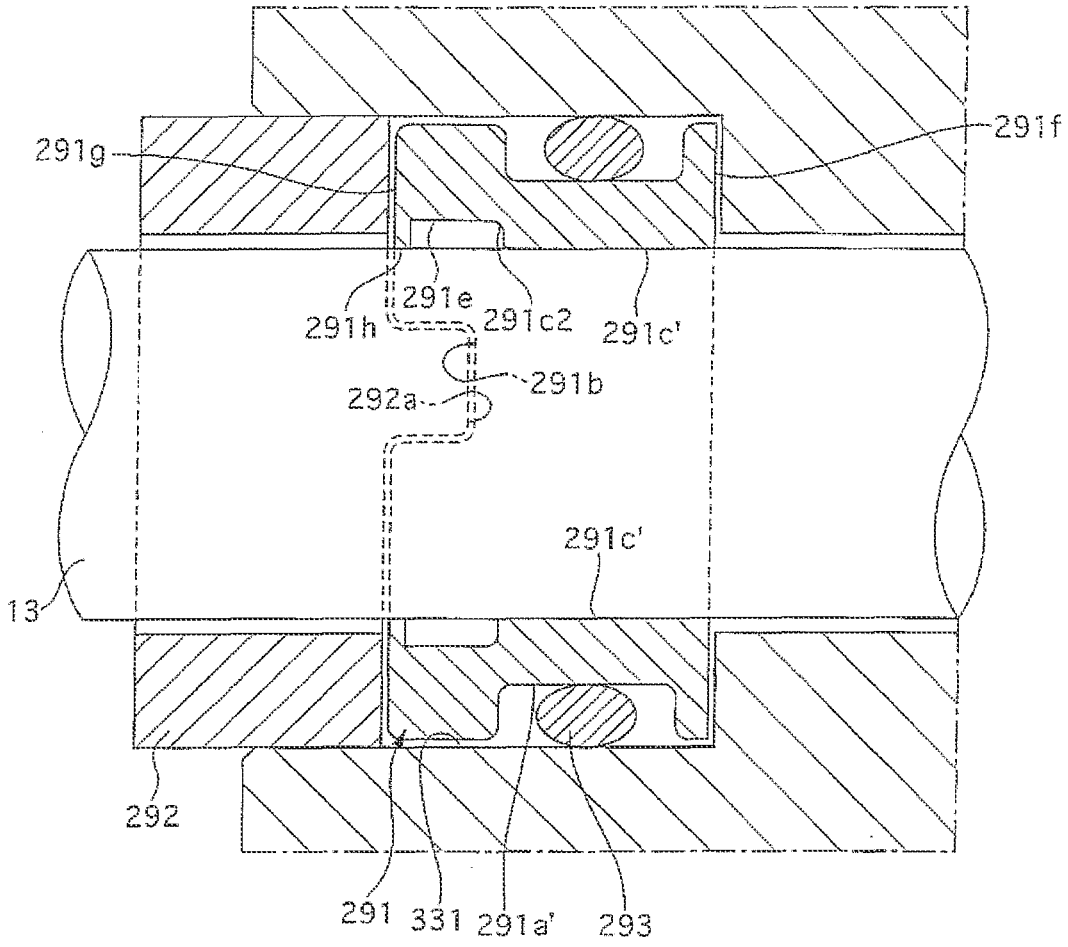
FIG. 8 is a cross-sectional view illustrating the construction of a pressure-reducing seal member in a pump device of the third embodiment.

The third embodiment is hereinafter explained. The fundamental construction is similar to the second embodiment, and therefore only the points of difference are hereunder described. FIG. 8 is the cross-sectional view illustrating the construction of the pressure-reducing seal member in the pump device of the third embodiment. As a different point, in the second embodiment the axial end of the second inner circumferential surface 291*e*, facing the motor side, is configured to open in the axial direction, but in the third embodiment the axial end of the second inner circumferential surface 291*e*, facing the motor side, is formed with an abutting part 291*h* having an inside diameter approximately equal to the inside diameter of seal part 291*c*'. In this manner, seal member 291 is formed with two spaced abutting sections by which the seal member can be brought at both ends into abutted-engagement with the outer circumference of drive shaft 13, thereby suppressing centrifugal whirling of the drive shaft 13, and thus ensuring a stable seal function.

The pump device of the third embodiment can provide the following effects.

(6-7) The second inner circumferential surface 291*e* (the diametrically-enlarged part) is formed with an abutting part 291*h* kept in abutted-engagement with an outer circumferential surface of the drive shaft 13.

Hence, it is possible to suppress centrifugal whirling of the drive shaft 13, and thus providing a stable seal function.

(7-8) The abutting part 291*h* is formed to extend radially inward from an end face 291*g* (an end face at the other end) of seal member 291, facing the motor.

Hence, drive shaft 13 can be supported at both ends of seal member 291, thereby more certainly suppressing centrifugal whirling of the drive shaft.

By the way, in the third embodiment, the second inner circumferential surface 291*e* is formed around the entire circumference. In lieu thereof, the second inner circumferential surface 291*e* may be partially formed only within a particular area of the inner circumference.

[Fourth Embodiment]

Figure 9:
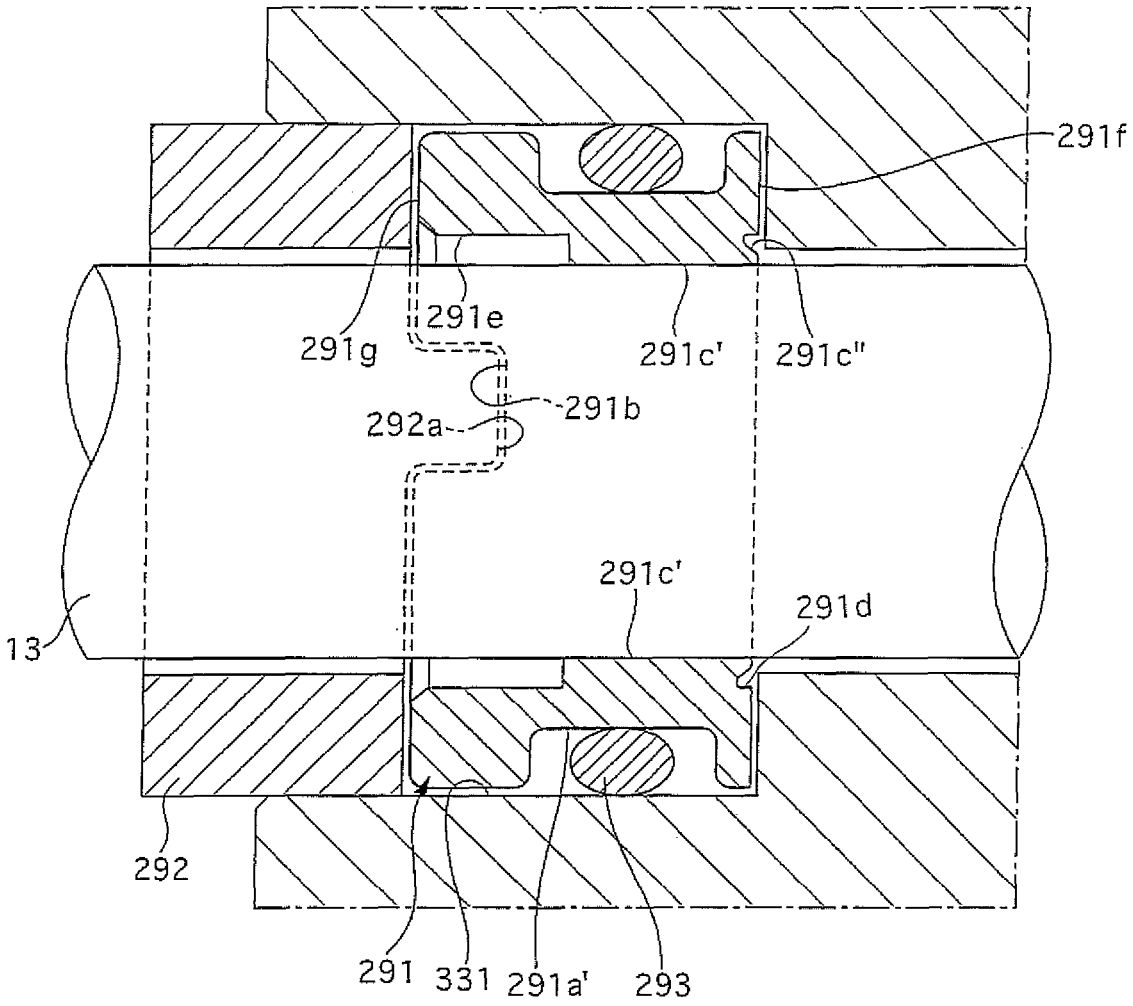
FIG. 9 is a cross-sectional view illustrating the construction of a pressure-reducing seal member in a pump device of the fourth embodiment.

The fourth embodiment is hereinafter explained. The fundamental construction is similar to the second embodiment, and therefore only the points of difference are hereunder described. FIG. 9 is the cross-sectional view illustrating the construction of the pressure-reducing seal member in the pump device of the fourth embodiment. As a different point, in the second embodiment the end face 291*f* is configured to extend vertically along the radial direction of drive shaft 13, but in the fourth embodiment the first inner circumferential surface 291*d* is formed to slightly extend from the end face 291*f* toward the motor side, and additionally a sloped surface 291*c*" is provided or configured to be inclined from the first inner circumferential surface 291*d* toward the end face 291*f* on the side of gear pump 3.

In this manner, the sloped surface 291*c*" is also provided. Hence, in the case that high-pressure brake fluid is leaking, a pushing force, which pushes the seal member against the drive shaft 13, acts along the sloped surface 291*c*", and thus it is possible to more greatly enhance the sealing performance. In particular, forming a lip portion, such as the sloped surface 291*c*", facilitates elastic deformation, thereby ensuring very close-fitting between the lip part and the drive shaft 13.

(8-4) The connecting surface has a sloped surface 291*c*" provided on a side of the first inner circumferential surface 291*d* (on a side of the given inner circumferential surface) and configured to be tapered toward a side of gear pump 3 (toward an end face of 291*f* at the one end).

Hence, it is possible to more greatly enhance the sealing performance.

By the way, in the fourth embodiment, pressure-reducing seal member 29 itself is provided with the sloped surface 291*c*", and also the sloped surface is configured at only one end of the pressure-reducing seal member. Assuming that the invention has been applied to the drive-side holder member 23 or the driven-side holder member 25, it is preferable to form on both sides respective sloped surfaces. Hereby, even when brake fluid has been leaked from any side, it is possible to ensure an appropriate sealing performance.

[Fifth Embodiment]

Figure 10:
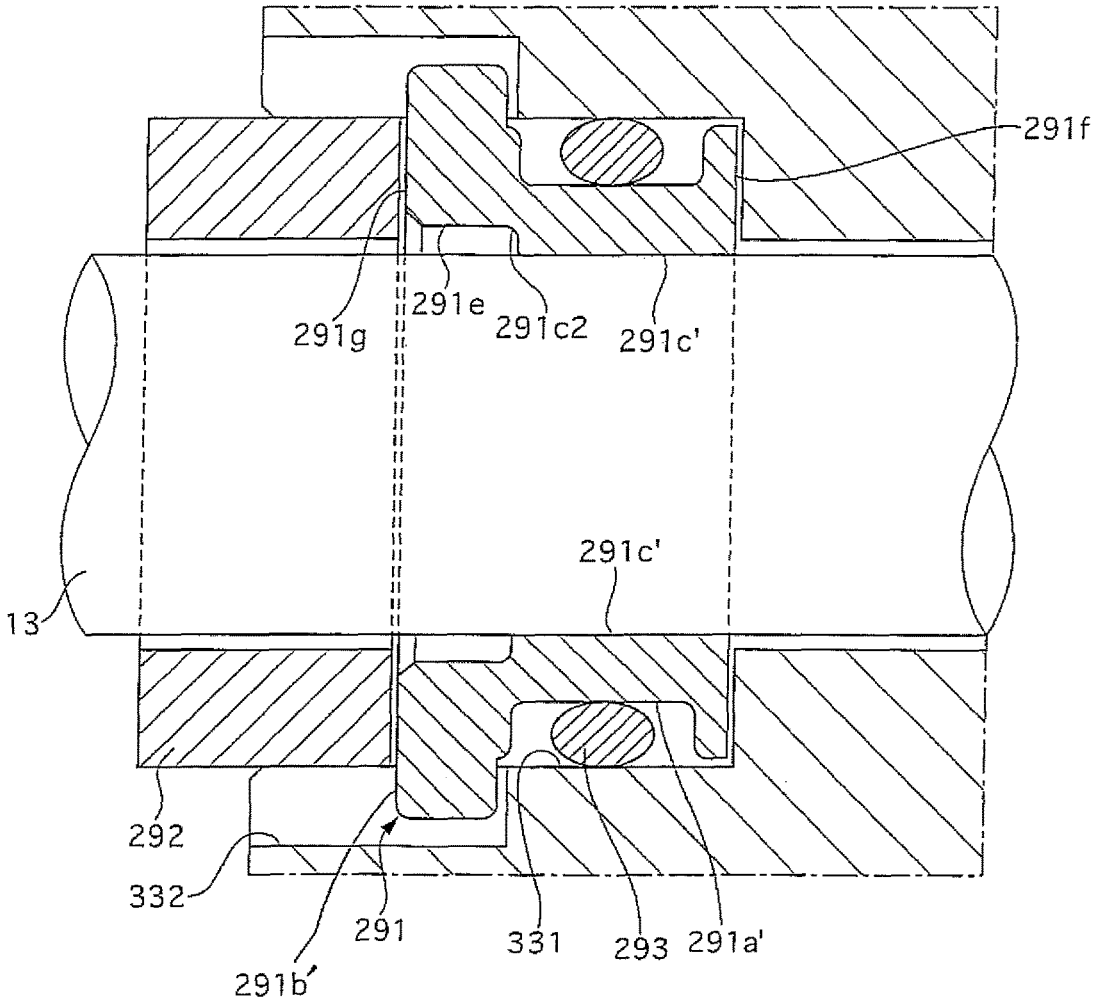
FIG. 10 is a cross-sectional view illustrating the construction of a pressure-reducing seal member in a pump device of the fifth embodiment.

The fifth embodiment is hereinafter explained. The fundamental construction is similar to the second embodiment, and therefore only the points of difference are hereunder described. FIG. 10 is the cross-sectional view illustrating the construction of the pressure-reducing seal member in the pump device of the fifth embodiment. As a different point, in the second embodiment a rotation-stop function is achieved by engagement of the recessed portion 291*b*, which is axially cut from the end face 291*g* of seal member 291, facing the motor side, with the protruding portion 292*a* of restriction member 292, but in the fifth embodiment the outer circumference of seal member 291, corresponding to the second inner circumferential surface 291*e*, is formed with an engaging protruding portion 291*b*', and the opening end of front case 33 has an engaged recessed portion 332 configured at a position corresponding to the engaging protruding portion 291*b*'. In such a case, restriction member 292 acts to restrict a movement of seal member 291 only in the axial direction. On the other hand, a movement of seal member 291 in the rotation direction is restricted by means of the engaging protruding portion 291*b*' and the engaged recessed portion 332 kept in engagement with each other. Thus, the fifth embodiment can provide the same operation and effects as the embodiments shown and described previously.

[Other Embodiments]

As discussed above, the mode for carrying out the invention has been explained in reference to the shown embodiments, it will be understood that the invention is not limited to the particular embodiments shown and described herein, but that various changes and modifications may be made without departing from the scope or spirit of this invention. The invention can be applied to any type of pump device, which is driven by the motor shaft (the motor rotation axis), but not limited to a tandem gear pump, an external gear pump or the like.

Additionally, in the shown embodiments, the invention has been applied to the pressure-reducing seal member. Similarly, the invention may be applied to another type of seals. For instance, in the case that the invention may be applied to the drive-side holder member 23 or the driven-side holder member 25, the same operation and effects as previously discussed can be provided. In such a case, it is preferable to form on both sides of each of these holder members respective inner circumferential surfaces. Hereby, even when brake fluid has been leaked from any side of the gear pump, it is possible to ensure an appropriate sealing performance.

The features grasped from the embodiments shown and described are enumerated, as follows:

(1) A pump device includes a housing, a drive shaft fitted into a shaft hole formed in the housing and driven by a driving power source, a pump installed in a pump chamber, formed in the housing and configured to be continuous with the shaft hole, and driven by the drive shaft, and a hollow seal member kept in abutted-engagement with the shaft hole via an elastic body and kept in sliding-contact with an outer circumference of the drive shaft for sealing against a leakage of fluid from the pump chamber. The seal member is provided with a seal part formed within an area at one end and kept in sliding-contact with the outer circumference of the drive shaft over a given hollow inner circumferential surface, and a rotation-stopping part formed within an area at the other end for restricting a movement of the seal member in a rotation direction of the drive shaft. A rotational resistance of the rotation-stopping part to the drive shaft is set to be less than a rotational resistance of the seal part.

Hence, it is possible to suppress the rotational resistance of the drive shaft, thereby suppressing a deterioration in mechanical efficiency.

(2) In the pump device as recited in the item (1), an annular clearance space is provided between a hollow inner circumferential surface corresponding to the rotation-stopping part and an outer circumferential surface of the drive shaft.

Hence, it is possible to extremely reduce the rotational resistance, thereby highly suppressing a deterioration in mechanical efficiency.

(3) In the pump device as recited in the item (2), the annular clearance space is defined by a second inner circumferential surface, which is diametrically enlarged from the given hollow inner circumferential surface, and a connecting surface that connects the second inner circumferential surface and the given inner circumferential surface.

Hence, it is possible to avoid sliding contact of the diametrically-enlarged inner circumferential surface except the given inner circumferential surface with the drive shaft, thereby suppressing a deterioration in mechanical efficiency.

(4) In the pump device as recited in the item (2), the annular clearance space includes a first annular clearance space defined by a first inner circumferential surface, which is diametrically enlarged from the given hollow inner circumferential surface and configured to extend toward an end face at the one end, and a first connecting surface that connects the first inner circumferential surface and the given inner circumferential surface, and a second annular clearance space defined by a second inner circumferential surface, which is diametrically enlarged from the given hollow inner circumferential surface and configured to extend toward an end face at the other end, and a second connecting surface that connects the second inner circumferential surface and the given inner circumferential surface. The first connecting surface has a sloped surface tapered toward the end face at the one end to provide a seal lip around the outer circumference of the drive shaft.

Hence, it is possible to provide an action such that the seal part is pushed against the drive shaft by fluid pressure exerted on the sloped surface, thereby highly enhancing the sealing performance.

(5) In the pump device as recited in the item (1), the elastic body is fitted into an annular groove formed in an outer circumferential surface of the seal member, and the seal part is configured to have a width substantially conformable to an axial width of the annular groove.

Hence, it is possible to apply a pushing force by which the seal member is forced radially inward when high pressure has been introduced into the annular groove due to a leakage of working fluid, and therefore it is possible to provide an adequate sealing performance even in the case of the seal part whose axial width is short. Additionally, during non-leak, it is possible to reduce the sliding frictional drag, because of the short axial width of the seal part, and therefore it is possible to suppress a deterioration in mechanical efficiency.

(6) In the pump device as recited in the item (1), a diametrically-enlarged part, formed by diametrically enlarging a hollow inner circumferential surface corresponding to the rotation-stopping part, is provided.

Hence, even when the axial length of the seal member becomes longer due to the provision of the rotation-stopping part, it is possible to suppress a sliding frictional drag of the seal member with the drive shaft, thereby suppressing a deterioration in mechanical efficiency.

(7) In the pump device as recited in the item (6), the diametrically-enlarged part is formed with an abutting part kept in abutted-engagement with an outer circumferential surface of the drive shaft.

Hence, it is possible to support the drive shaft at a plurality of places, thereby suppressing centrifugal whirling of the drive shaft, and thus ensuring a stable sealing performance.

(8) In the pump device as recited in the item (7), the abutting part is formed to extend radially inward from an end face.

Hence, it is possible to secure the axial distance between the seal part and the abutting part, thereby more certainly suppressing centrifugal whirling of the drive shaft, and thus ensuring a stable sealing performance.

(9) In the pump device as recited in the item (1), the rotation-stopping part is configured to extend radially.

Hence, it is unnecessary to form a given notch or cut in the seal part, and therefore it is possible to enhance a mechanical strength of the seal part.

(10) In the pump device as recited in the item (1), the rotation-stopping part has an engaged portion configured to extend along an axial direction of the drive shaft for stopping rotation with respect to the housing.

Hence, it is possible to realize rotation-stop, while attaining the compact radial dimension.

(11) In the pump device as recited in the item (1), the rotation-stopping part is configured to engage with an engaged portion formed in the housing.

Hence, it is possible to restrict the seal member with respect to the housing in the rotation direction, thereby enhancing the durability of the elastic body.

(12) In a pump device equipped with a gear pump having a drive shaft driven by a driving power source, a first gear rotated integrally with the drive shaft and constructing a first pump, and a second gear rotated integrally with the drive shaft and constructing a second pump, for discharging working fluid, introduced from an outside of the pump device into a suction chamber, into an outside of the pump device, the pump device is comprised of a first side plate interposed between the first gear and the second gear and provided on one side face of two opposing side faces of the two gears in a fluid-tight fashion, a shaft hole, which is formed in the first side plate and through which the drive shaft is fitted, a second side plate provided on the other side face of the two opposing side faces of the two gears in a fluid-tight fashion, addendum seal blocks each having a sealing surface for sealing an addendum of each of the two gears and configured to define the suction chamber in conjunction with each of the side plates, and a hollow seal member kept in abutted-engagement with the shaft hole via an elastic body and kept in sliding-contact with an outer circumference of the drive shaft for sealing between the first pump and the second pump. The seal member is provided with a seal part kept in sliding-contact with the outer circumference of the drive shaft over a given hollow inner circumferential surface, and a rotation-stopping part configured to restrict a movement of the seal member in a rotation direction of the drive shaft. A clearance space is defined between an inner circumferential surface of the rotation-stopping part and an outer circumferential surface of the drive shaft.

Hence, it is possible to suppress the rotational resistance of the drive shaft, thereby suppressing a deterioration in mechanical efficiency.

(13) In the pump device as recited in the item (12), the seal member is configured to stop rotation with respect to the first side plate.

Hence, it is possible to restrict a movement of the seal member in the rotation direction, thereby enhancing the durability of the elastic body.

(14) In the pump device as recited in the item (13), the clearance space is an annular clearance space defined between a hollow inner circumferential surface and the outer circumferential surface of the drive shaft.

Hence, it is possible to extremely reduce the rotational resistance, thereby highly suppressing a deterioration in mechanical efficiency.

(15) In the pump device as recited in the item (14), the annular clearance space is defined by a second inner circumferential surface, which is diametrically enlarged from the given hollow inner circumferential surface, and a connecting surface that connects the second inner circumferential surface and the given inner circumferential surface.

Hence, it is possible to avoid sliding contact of the diametrically-enlarged inner circumferential surface except the given inner circumferential surface with the drive shaft, thereby suppressing a deterioration in mechanical efficiency.

(16) In the pump device as recited in the item (15), the elastic body is fitted into an annular groove formed in an outer circumferential surface of the seal member, and the seal part is configured to have a width substantially conformable to an axial width of the annular groove.

Hence, it is possible to apply a pushing force by which the seal member is forced radially inward when high pressure has been introduced into the annular groove due to a leakage of working fluid, and therefore it is possible to provide an adequate sealing performance even in the case of the seal part whose axial width is short. Additionally, during non-leak, it is possible to reduce the sliding frictional drag, because of the short axial width of the seal part, and therefore it is possible to suppress a deterioration in mechanical efficiency.

(17) In the pump device as recited in the item (14), the annular clearance space includes a first annular clearance space defined by a first inner circumferential surface, which is diametrically enlarged from the given hollow inner circumferential surface and configured to extend toward an end face at the one end, and a first connecting surface that connects the first inner circumferential surface and the given inner circumferential surface, in addition to a second annular clearance space defined by a second inner circumferential surface, which is diametrically enlarged from the given hollow inner circumferential surface and configured to extend toward an end face at the other end, and a second connecting surface that connects the second inner circumferential surface and the given inner circumferential surface. The first connecting surface has a sloped surface tapered toward the end face at the one end to provide a seal lip around the outer circumference of the drive shaft.

Hence, it is possible to provide an action such that the seal part is pushed against the drive shaft by fluid pressure exerted on the sloped surface, thereby highly enhancing the sealing performance.

(18) In the pump device as recited in the item (15), the diametrically-enlarged surface is formed with an abutting part kept in abutted-engagement with the outer circumferential surface of the drive shaft.

Hence, it is possible to support the drive shaft at a plurality of places, thereby suppressing centrifugal whirling of the drive shaft, and thus ensuring a stable sealing performance.

(19) In a pump device used for a brake apparatus and having a drive shaft driven by a driving power source, a first gear integrally formed with and rotated together with the drive shaft and constructing a first pump, and a second gear integrally formed with and rotated together with the drive shaft and constructing a second pump, for discharging working fluid, introduced from an outside of the pump device into a suction chamber, into an outside of the pump device, the first pump and the second pump incorporated in respective brake-circuit systems different from each other, the pump device is comprised of a side plate interposed between the first gear and the second gear and having a shaft hole through which the drive shaft penetrates and configured to suppress a leakage of brake fluid from one side face of two opposing side faces of the two gears adjacent to each other, a side plate provided in close proximity to the other side face of the two opposing side faces of the two gears and configured to suppress a leakage of brake fluid from the other side face, addendum seal blocks each having a sealing surface for sealing an addendum of each of the two gears and configured to define the suction chamber in conjunction with each of the side plates, and a hollow seal member installed in the shaft hole for sealing between the first pump and the second pump and kept in abutted-engagement with the shaft hole via an elastic body. The seal member is provided with a seal part kept in sliding-contact with an outer circumference of the drive shaft over a given hollow inner circumferential surface, and a rotation-stopping part configured to restrict a movement of the seal member in a rotation direction of the drive shaft. An annular clearance space is provided between a hollow inner circumferential surface corresponding to the rotation-stopping part and an outer circumferential surface of the drive shaft.

Hence, it is possible to suppress the rotational resistance of the drive shaft, thereby suppressing a deterioration in mechanical efficiency.

(20) In the pump device as recited in the item (19), the elastic body is fitted into an annular groove formed in an outer circumferential surface of the seal member, and the seal part is configured to have a width substantially conformable to an axial width of the annular groove. The rotation-stopping part has an engaged portion configured to extend along an axial direction of the drive shaft for stopping rotation with respect to the housing.

Hence, it is possible to apply a pushing force by which the seal member is forced radially inward when high pressure has been introduced into the annular groove due to a leakage of working fluid, and therefore it is possible to provide an adequate sealing performance even in the case of the seal part whose axial width is short. Additionally, during non-leak, it is possible to reduce the sliding frictional drag, because of the short axial width of the seal part, and therefore it is possible to suppress a deterioration in mechanical efficiency. Also, it is possible to realize rotation-stop, while attaining the compact radial dimension.

REFERENCE SIGNS LIST

1 . . . Housing
2 . . . Motor
3 . . . Gear pump
4 . . . Electromagnetic valves
5 . . . Control board
6 . . . Housing main body
7 . . . Cover member
9 . . . Axial-direction positive side face
10 . . . Axial-direction negative side face
11 . . . Accommodation part
12 . . . Pump case
13 . . . Drive shaft
14 . . . Driven shaft
21 . . . Seal block
21*a* . . . Side plate
22 . . . Seal block
22*a* . . . Side plate
23 . . . Drive-side holder member
24 . . . Drive-side side plate fitting members
25 . . . Driven-side holder member
26 . . . Driven-side side plate fitting members
29 . . . Pressure-reducing seal member
33 . . . Front case
34 . . . Center plate
35 . . . Rear case
291 . . . Seal member
291*a* . . . O-ring groove
291*b* . . . Recessed portion
291*b* ". . . Engaging protruding portion
291*c* . . . Seal part
291*c*1 . . . Connecting surface
291*c*2 . . . Connecting surface
291*c*2"". . . Sloped surface
291*d* . . . First inner circumferential surface
291*e* . . . Second inner circumferential surface
291*g* . . . End face of the motor side
291*h* . . . Abutting part
292 . . . Restriction member
292*a* . . . Protruding portion
293 . . . O ring
331 . . . Shaft hole
332 . . . Engaged recessed portion

The invention claimed is:

1. A pump device comprising:

a housing;

a drive shaft fitted into a shaft hole formed in the housing and driven by a driving power source;

a pump installed in a pump chamber, formed in the housing and configured to be continuous with the shaft hole, and driven by the drive shaft; and a hollow seal member kept in abutted-engagement with the shaft hole via an elastic body and kept in sliding-contact with an outer circumference of the drive shaft for sealing against a leakage of fluid from the pump chamber, wherein:

the seal member is provided with a seal part formed within an area at one end and kept in sliding-contact with the outer circumference of the drive shaft over a given hollow inner circumferential surface, and a rotation-stopping part formed within an area at the other end for restricting a movement of the seal member in a rotation direction of the drive shaft, a resistance of the rotation-stopping part to rotary motion of the drive shaft is set to be less than a resistance of the seal part to the rotary motion of the drive shaft, the elastic body is fitted into an annular groove formed in an outer circumferential surface of the seal member, and a sliding contact surface of the seal part kept in sliding-contact with the outer circumference of the drive shaft is configured to have a width substantially corresponding to an axial width of the annular groove of the elastic body.

2. The pump device as recited in claim 1, wherein:

an annular clearance space is provided between a hollow inner circumferential surface corresponding to the rotation-stopping part and an outer circumferential surface of the drive shaft.

3. The pump device as recited in claim 2, wherein:

the annular clearance space is defined by a second inner circumferential surface, which is diametrically enlarged from the given hollow inner circumferential surface, and a connecting surface that connects the second inner circumferential surface and the given inner circumferential surface.

4. The pump device as recited in claim 1, wherein:

a diametrically-enlarged part, formed by diametrically enlarging a hollow inner circumferential surface corresponding to the rotation-stopping part, is provided.

5. The pump device as recited in claim 1, wherein:

the rotation-stopping part has an engaged portion configured to extend along an axial direction of the drive shaft for stopping rotation with respect to the housing.

6. A pump device equipped with a gear pump having a drive shaft driven by a driving power source, a first gear rotated integrally with the drive shaft and constructing a first pump, and a second gear rotated integrally with the drive shaft and constructing a second pump, for pressurizing working fluid introduced into each individual suction chamber of each of the first pump and the second pump and for discharging the pressurized working fluid from each individual discharge port of each of the first pump and the second pump, the pump device comprising:

a first side plate interposed between the first gear and the second gear and provided on one side face of two opposing side faces of the two gears in a fluid-tight fashion;

a shaft hole, which is formed in the first side plate and through which the drive shaft is fitted;

a second side plate provided on the other side face of the two opposing side faces of the two gears in a fluid-tight fashion;

addendum seal blocks each having a sealing surface for sealing an addendum of each of the two gears and configured to define the suction chamber in conjunction with each of the side plates; and a hollow seal member kept in abutted-engagement with the shaft hole via an elastic body and kept in sliding-contact with an outer circumference of the drive shaft for sealing between the first pump and the second pump, wherein the seal member is provided with a seal part kept in sliding-contact with the outer circumference of the drive shaft over a given hollow inner circumferential surface, and a rotation-stopping part configured to restrict a movement of the seal member in a rotation direction of the drive shaft, a clearance space is defined between an inner circumferential surface of the rotation-stopping part and an outer circumferential surface of the drive shaft, the elastic body is fitted into an annular groove formed in an outer circumferential surface of the seal member, and a sliding-contact surface of the seal part kept in sliding-contact with the outer circumference of the drive shaft is configured to have a width substantially corresponding to an axial width of the annular groove of the elastic body.

7. The pump device as recited in claim 6, wherein:

the seal member is configured to stop rotation with respect to the first side plate.

8. The pump device as recited in claim 7, wherein:

the clearance space is an annular clearance space defined between a hollow inner circumferential surface and the outer circumferential surface of the drive shaft.

9. The pump device as recited in claim 8, wherein:

the annular clearance space is defined by a second inner circumferential surface, which is diametrically enlarged from the given hollow inner circumferential surface, and a connecting surface that connects the second inner circumferential surface and the given inner circumferential surface.

10. A pump device used for a brake apparatus and having a drive shaft driven by a driving power source, a first gear integrally formed with and rotated together with the drive shaft and constructing a first pump, and a second gear integrally formed with and rotated together with the drive shaft and constructing a second pump, for pressurizing working fluid introduced into each individual suction chamber of each of the first pump and the second pump and for discharging the pressurized working fluid from each individual discharge port of each of the first pump and the second pump, the first pump and the second pump incorporated in respective brake-circuit systems different from each other, the pump device comprising:

a first side plate interposed between the first gear and the second gear and having a shaft hole through which the drive shaft penetrates and configured to suppress a leakage of brake fluid from one side face of two opposing side faces of the two gears adjacent to each other;

a second side plate provided adjacent to the other side face of the two opposing side faces of the two gears and configured to suppress a leakage of brake fluid from the other side face;

addendum seal blocks each having a sealing surface for sealing an addendum of each of the two gears and configured to define the suction chamber in conjunction with each of the side plates; and a hollow seal member installed in the shaft hole for sealing between the first pump and the second pump and kept in abutted-engagement with the shaft hole via an elastic body, wherein the seal member is provided with a seal part kept in sliding-contact with an outer circumference of the drive shaft over a given hollow inner circumferential surface, and a rotation-stopping part configured to restrict a movement of the seal member in a rotation direction of the drive shaft, an annular clearance space is provided between a hollow inner circumferential surface corresponding to the rotation-stopping part and an outer circumferential surface of the drive shaft, the elastic body is fitted into an annular groove formed in an outer circumferential surface of the seal member, a sliding-contact surface of the seal part kept in sliding-contact with the outer circumference of the drive shaft is configured to have a width substantially corresponding to an axial width of the annular groove of the elastic body, and the rotation-stopping part has an engaged portion configured to extend along an axial direction of the drive shaft for stopping rotation with respect to the housing.

* * * * *